US011389814B1

(12) United States Patent
Arminak

(10) Patent No.: US 11,389,814 B1
(45) Date of Patent: Jul. 19, 2022

(54) ALL PLASTIC HAND PUMP WITH A PISTON HAVING AN INTEGRATED CHECK VALVE

(71) Applicant: Armin Arminak, Pasadena, CA (US)

(72) Inventor: Armin Arminak, Pasadena, CA (US)

( * ) Notice: Subject to any disclaimer, the term of this patent is extended or adjusted under 35 U.S.C. 154(b) by 0 days.

(21) Appl. No.: 17/377,086

(22) Filed: Jul. 15, 2021

Related U.S. Application Data

(60) Provisional application No. 63/175,651, filed on Apr. 16, 2021.

(51) Int. Cl.
*B05B 11/00* (2006.01)

(52) U.S. Cl.
CPC ..... *B05B 11/3067* (2013.01); *B05B 11/007* (2013.01); *B05B 11/3016* (2013.01); *B05B 11/3052* (2013.01); *B05B 11/3074* (2013.01); *B05B 11/3087* (2013.01)

(58) Field of Classification Search
USPC ..... 222/321.9, 321.7, 321.1
See application file for complete search history.

(56) References Cited

U.S. PATENT DOCUMENTS 3,138,301 A 6/1964 Ward
3,282,472 A * 11/1966 Roder ..... B05B 11/3001 222/321.9
3,726,442 A 4/1973 Davidson et al.
4,036,438 A 7/1977 Soderlind et al.
4,146,155 A 3/1979 Kutik et al.
4,155,487 A 5/1979 Blake
4,174,056 A 11/1979 Loeffler
4,191,313 A 3/1980 Blake et al.
4,201,317 A 5/1980 Aleff
4,241,853 A 12/1980 Pauls et al.
4,371,097 A * 2/1983 O'Neill ..... B05B 11/3095 222/321.9
4,527,741 A 7/1985 Gameau
4,591,077 A 5/1986 Corsette
5,129,550 A 7/1992 Eschbach
5,301,846 A 4/1994 Schmitz
5,363,993 A 11/1994 Mascitelli et al.
5,673,824 A * 10/1997 Evans ..... B05B 11/0005 222/321.9
5,711,459 A 1/1998 Glynn
5,924,603 A 7/1999 Santagiuliana
5,960,998 A 10/1999 Brown
6,216,920 B1 4/2001 Baggett
6,276,568 B1 8/2001 Brotspies et al.
(Continued)

FOREIGN PATENT DOCUMENTS

DE 202007006997 U1 9/2007
EP 0691161 A1 1/1996
(Continued)

*Primary Examiner* — Lien M Ngo
(74) *Attorney, Agent, or Firm* — Cislo & Thomas, LLP

(57) ABSTRACT

A hand pump fabricated entirely from plastic components for dispensing liquids, is provided. The hand pump includes an actuator, a closure, a housing having a lower check valve, and a piston having an integrated upper check valve in the form of an inverted cone suspended within a cylinder. An elastic, dome shaped, plastic return spring is utilized to return the actuator to its rest position after actuation. Used pumps do not require disassembly to be recycled.

29 Claims, 8 Drawing Sheets

(56) References Cited

U.S. PATENT DOCUMENTS

| | | | | |
|---|---|---|---|---|
| 6,290,145 | B1 * | 9/2001 | Mizushima | B05B 7/0025 222/321.9 |
| 6,871,798 | B2 | 3/2005 | Mathiez | |
| 7,246,723 | B2 * | 7/2007 | Santagiuliana | B05B 11/3059 222/207 |
| 7,578,417 | B2 * | 8/2009 | Son | B05B 11/0075 222/257 |
| 7,942,291 | B2 | 5/2011 | Foster | |
| 8,012,339 | B2 | 9/2011 | Field | |
| 9,522,403 | B2 | 12/2016 | Hui et al. | |
| 9,937,509 | B2 * | 4/2018 | DeJong | B05B 11/3001 |
| 9,962,723 | B2 * | 5/2018 | Baughman | B05B 7/0037 |
| D845,127 | S | 4/2019 | Arminak | |
| 10,246,249 | B2 | 4/2019 | Hui et al. | |
| 10,252,284 | B2 | 4/2019 | Arminak | |
| 10,335,816 | B1 * | 7/2019 | Arminak | B05B 11/3023 |
| 10,434,532 | B2 | 10/2019 | Ophardt et al. | |
| 10,493,478 | B2 | 12/2019 | Arminak | |
| D876,234 | S | 2/2020 | Arminak | |
| 10,898,034 | B1 | 1/2021 | Arminak | |
| 11,236,794 | B2 | 2/2022 | Deman et al. | |
| 2003/0116588 | A1 | 6/2003 | Santagiuliana | |
| 2004/0055457 | A1 | 3/2004 | Masuda | |
| 2005/0115990 | A1 * | 6/2005 | Kang | B05B 11/3053 222/321.9 |
| 2006/0255071 | A1 | 11/2006 | Behar et al. | |
| 2008/0000933 | A1 * | 1/2008 | Marelli | B05B 11/3097 222/340 |
| 2011/0017779 | A1 * | 1/2011 | Rossignol | B05B 11/3077 222/321.9 |
| 2012/0267399 | A1 | 10/2012 | Moretti | |
| 2016/0318053 | A1 | 11/2016 | De Jong | |
| 2016/0332181 | A1 * | 11/2016 | DeMan | B05B 11/3069 |
| 2017/0225183 | A1 | 8/2017 | Kelly | |
| 2017/0265691 | A1 | 9/2017 | Ophardt et al. | |
| 2017/0291185 | A1 | 10/2017 | Kim et al. | |
| 2017/0326567 | A1 | 11/2017 | Santagiuliana | |
| 2018/0171998 | A1 | 6/2018 | Sun | |
| 2020/0290793 | A1 | 9/2020 | Driskell | |
| 2021/0000306 | A1 | 1/2021 | Arminak | |

FOREIGN PATENT DOCUMENTS

| | | | |
|---|---|---|---|
| EP | 1938903 | A2 | 7/2008 |
| EP | 2457667 | A1 | 5/2012 |
| JP | H07101480 | A | 4/1995 |
| JP | 2014166624 | A | 9/2014 |

* cited by examiner

ALL PLASTIC HAND PUMP WITH A PISTON HAVING AN INTEGRATED CHECK VALVE

CROSS-REFERENCES TO RELATED APPLICATION

This application claims the benefit of U.S. Provisional Application Ser. No. 63/175,651, filed Apr. 16, 2021 and entitled "All Plastic Mist Sprayer," which is incorporated here by this reference.

BACKGROUND OF THE INVENTION

Field of the Invention

This invention relates to hand operated liquid dispensing pumps used in the personal care industry and, in particular, to hand pumps comprised of all plastic components.

Background Art

Hand operated dispensing pumps are well-known in the personal care industry for dispensing liquids, including liquids in the form of mists, sprays, foams and creams. The majority of pumps for dispensing liquids presently available are made from plastic but include at least a metal compression spring to return the pump actuator to its starting position after being depressed. Typically, hand operated dispensing pumps are preinstalled on a fluid filled container prior to sale and are disposed of along with the container when the contents of the container are depleted. The pumps are not typically intended to be reused. Although pumps using metal return springs operate effectively, and are of relatively low cost to make, they have certain drawbacks. In particular, the steel compression springs typically used in such pumps make the pumps difficult to recycle and may cause rust contamination of the product to be dispensed.

Plastic parts are recycled by grinding or shredding the parts. The shredded material may then be reused, typically by melting the material and mixing it with new plastic. To be suitable for grinding or shredding, used plastic must be free of any metal parts. A hand pump using a metal return spring, or any metal components, must be disassembled to remove the metal components prior to recycling the plastic materials which compose the bulk of the pump. The need to disassemble a used hand pump to remove the metal components prior to recycling increases costs and has the effect of decreasing the desirability of used hand pumps as a source of recycled plastic. Thus, there is a need in the art for hand pumps capable of dispensing liquids made of all plastic components. Such pumps would require no disassembly prior to being ground or shredded for use as recycled plastic.

SUMMARY OF THE INVENTION

The present invention meets a long-felt need in the art by providing a new hand pump design for dispensing liquids where the pump is fabricated entirely from plastic materials. The all plastic hand pump of the present invention, lacking any metal parts, is easy to recycle and also eliminates potential contamination of the product to be dispensed due to rusting of the steel compression springs typically found in prior art hand pumps.

The major components of the hand pump of the present invention comprise an actuator, a pump housing configured with a ball style lower check valve, a closure, a piston configured with an integral upper check valve and, a plastic return spring. In use, the hand pump will be mounted on a container containing a liquid to be dispensed and a dip tube will attach to a bottom of the pump housing and into the fluid to be dispensed.

The piston of the hand pump is a single injection molded component having a lower portion and an upper portion. The lower portion is configured as a thin wall, hollow, truncated cone which is connected to the upper portion which is configured as a thin wall, hollow cylinder. Suspended within the hollow cylinder of the upper portion is a hollow, inverted cone. The suspended inverted cone functions as the upper check valve.

The actuator of the hand pump includes a nozzle, wherein the actuator has a center tube having upper and lower ends. The upper end of the center tube is in fluid communication with the nozzle and the lower end of the center tube is in fluid communication with the upper portion of the piston. The exterior of the lower end of the center tube slides within the interior of the upper portion of the piston and the interior of the lower end of the center tube slides over the inverted cone suspended within the upper portion of the piston. This configuration allows air or fluid to pass between an interior cylindrical wall of the center tube and an upper circumference of the inverted cone, when the pump housing is pressurized on a downstroke of the actuator and consequently the piston which is connected thereto.

The piston reciprocates within a bore of the pump housing, which is configured with a ball style check valve at its lower end. The pump housing is connected to the collar, which includes threads for attachment to a container of fluid to be dispensed. Disposed between the collar and actuator and about the piston is the plastic return spring.

The hand pump of the present invention operates as follows. Assuming the pump is dry or unprimed, in a first step, a user presses downwardly on the actuator. Downwards motion of actuator simultaneously compresses the plastic return spring and causes the piston to move downwardly, as well. As the piston moves downwardly, pressure increases inside the pump housing which causes the lower check valve to close and the upper check valve to open forcing air to exit thru the orifice.

The upper check valve comprises the inverted cone suspended within the upper portion of the piston. The wall of the inverted cone is flexible and consequently, as a downstroke of the actuator pressurizes the housing, any air or fluid within the housing passes by the interface between the upper circumference of the inverted cone and the interior wall of the center tube of the actuator and subsequently through the center tube and out the nozzle. On a first actuation of a dry pump, air passes the upper check valve. On subsequent actions, fluid passes through the upper check valve.

In a second step, the actuator is released. When the actuator is released, the plastic return spring drives the actuator and the piston connected thereto upwardly. As the piston moves upwardly, the upper check valve is sealed causing vacuum inside the housing, which in turn causes the lower check valve to open and the liquid to be dispensed is then drawn up from the container into the pump housing via the dip tube which is attached to the bottom of the pump housing and which extends into the volume of liquid held within the container.

In the third step, the actuator is pressed downwardly a second time. As the actuator is pressed downwardly, the plastic spring is compressed and the piston connected to the actuator moves downwardly as well. Downwards movement of the piston causes pressurization of the pump housing. Pressurization causes the bottom check valve to close and the upper check valve to open. The liquid in the housing, previously draw up from the container in step 2, is forced through the upper check valve and exits the pump through an orifice of the nozzle. After the hand pump is initially primed in step one, each subsequent down stroke and up stroke cycle of the actuator will cause liquid in the housing to be dispensed from the nozzle and fresh liquid to be drawn from the container into the housing.

The above and other advantages of the all plastic hand pump of the present invention will be described in more detail below.

DETAILED DESCRIPTION OF THE PREFERRED EMBODIMENTS

Figure 1:
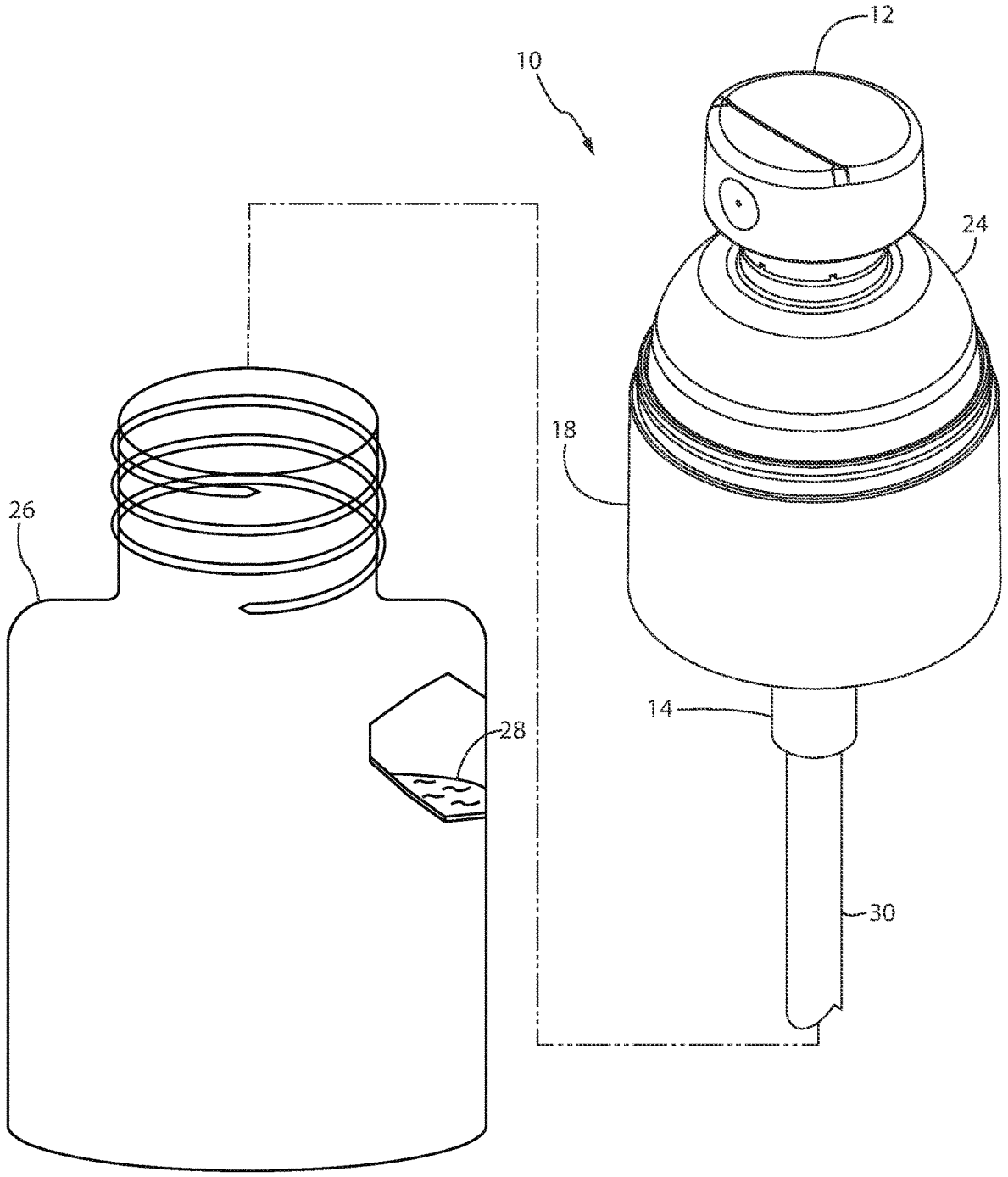
FIG. 1 is an exemplary perspective view of the hand pump of the present invention.

The present invention will now be described more fully hereinafter with reference to the accompanying drawings, in which preferred embodiments of the invention are shown. The invention however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Description of the Component Parts

With reference to FIGS. 1-7B, the hand pump 10 of the present invention comprises an actuator 12, a pump housing 14 configured with a ball style lower check valve 16, a closure 18, a piston 20 configured with an integral upper check valve 22 and, a plastic return spring 24. Typically, the hand pump 10 will be mounted on a dispenser container 26, containing a liquid 28. The hand pump 10 draws the liquid 28 from the dispenser container 26 via a dip tube 30.

With reference to FIGS. 2A-2B and 3A-3B, the piston 20 of the hand pump 10 is an injection molded component having a lower portion 34 and an upper portion 32. The lower portion 34 is configured as a thin wall, hollow, truncated cone having a lower circumference 36. The upper portion 32 is configured as a thin wall, hollow cylinder having an upper lip 38. Suspended within the upper portion is the check valve 22. The upper check valve 22 is configured as a hollow inverted cone having a flexible wall 42 and an upper circumference 40. The hollow inverted cone which forms the upper check valve 22 has a truncated end 114 with a cylindrical cavity 116 extending downwardly therefrom. The central cavity 116 allows for pre-compression of the fluid to be dispensed. The piston 20 also includes a central post 118 and fins 120 to direct the flow of fluid to be dispensed and reduce turbulence. The fins 120 suspend the upper check valve 22 within the upper portion 32 of the piston 20 and suspend the central post 118 within the lower portion 34 of the piston 20. The piston 20 further includes annular steps 122 which assist in controlling the shape of the piston during molding of the part.

With reference to FIGS. 2A-2B and 4A-4B, the actuator 12 of the hand pump 10 includes a nozzle 45 having a flow passage 44 which is in fluid communication with a center tube 46. The flow passage 44 has a first end 54 and a second end 56. The first end 54 includes an exit orifice 50. The exit orifice 50 may be configured to dispense pressurized liquid 28 from the hand pump 10 in a variety of forms such as a fan spray, jet spray or in the form of an atomized mist, or the like.

The actuator 12 also includes a ring element 104 which features at least one air vent 110 formed in the ring element 104. In the exemplary embodiment, a plurality of the at least one air vents 110 is disposed radially about the perimeter of the ring element 104. The at least one air vent 110 vents the volume of the pump body 14 above the level of the piston 20 to atmosphere.

The center tube 46 of the actuator 12 has an upper end 52 and a lower end 48. The upper end 52 is has a cylindrical interior surface 58 and the lower end 48 has a conical interior surface 60 and cylindrical exterior surface 62. The upper end 52 of the center tube 46 is in fluid communication with the flow passage 44 of the nozzle 45 at its second end 56 and the lower end 48 of the center tube is in fluid communication with the upper portion 32 of the piston 20.

With reference to FIGS. 2A-2B, 3A-3B and 4A-4B, the actuator 12 interfaces with the piston 20 as follows. The cylindrical exterior surface 62 of the lower end 48 of the center tube 46 slides within a cylindrical interior surface 64 of the upper portion 32 of the piston 20 and the conical interior surface 60 of the lower end 48 of the center tube 46 slides over the upper circumference 40 of the upper check valve 22, where the upper check valve 22 is configured as an inverted cone suspended within the upper portion 32 of the piston 20. The conical interior surface 60 of the lower end of the center tube 46 at least partially overlaps the inverted cone of the upper check valve 22. This configuration allows air or the liquid 28 to pass between the conical interior surface 60 of the center tube 46 and the upper circumference 40 of the upper check valve 22, when pump housing 14 is pressurized on a downstroke of the actuator 12.

With reference to FIGS. 2A-2B and 5A-5B, the pump housing 14 is a generally hollow, cylindrical housing having an upper body 70 and a lower body 72. The upper body 70 is configured as a cylindrical bore having an internal volume 68 and the lower body 72 is configured as a tube. The upper body 70 is open at an upper end 92 and transitions to the lower body 72 at a lower end. The upper end 92 of the upper body 70 is configured to engage with the pump housing 14 via a snap fit. The lower body 72 includes the lower check valve 16 which incorporates a plastic ball 74 to open and close an orifice 106 formed within the lower body 72, in response to pressure changes in the upper body 70. The lower body 72 is open at a lower end and is configured to accept the dip tube 30. The upper body 70 includes at least one vent hole 108, which vents the interior volume 68 to atmosphere on a downstroke of the actuator 12.

With reference to FIGS. 2A-2B and 6A-6B, the closure 18 of the present invention hand pump 10 comprises a generally circular lower portion 76 and a generally circular upper portion 78. The generally circular lower portion 76 includes screw threads 80 which interface the hand pump 10 with the dispenser container 26 containing the liquid 28 to be dispensed. The generally circular upper portion 78 includes a circular retaining channel 82 which retains a lower edge 84 of the plastic return spring 24. The closure 18 also includes an upper shelf portion 88 which includes a circular opening 86. When assembled the piston 20 is disposed through the circular opening 86 and into the upper body 70 of the pump housing 14. The closure also includes a lower ring-wall 90 which is configured to attach to the upper body 70 of the pump housing 14 via a snap fit.

Figure 2A:
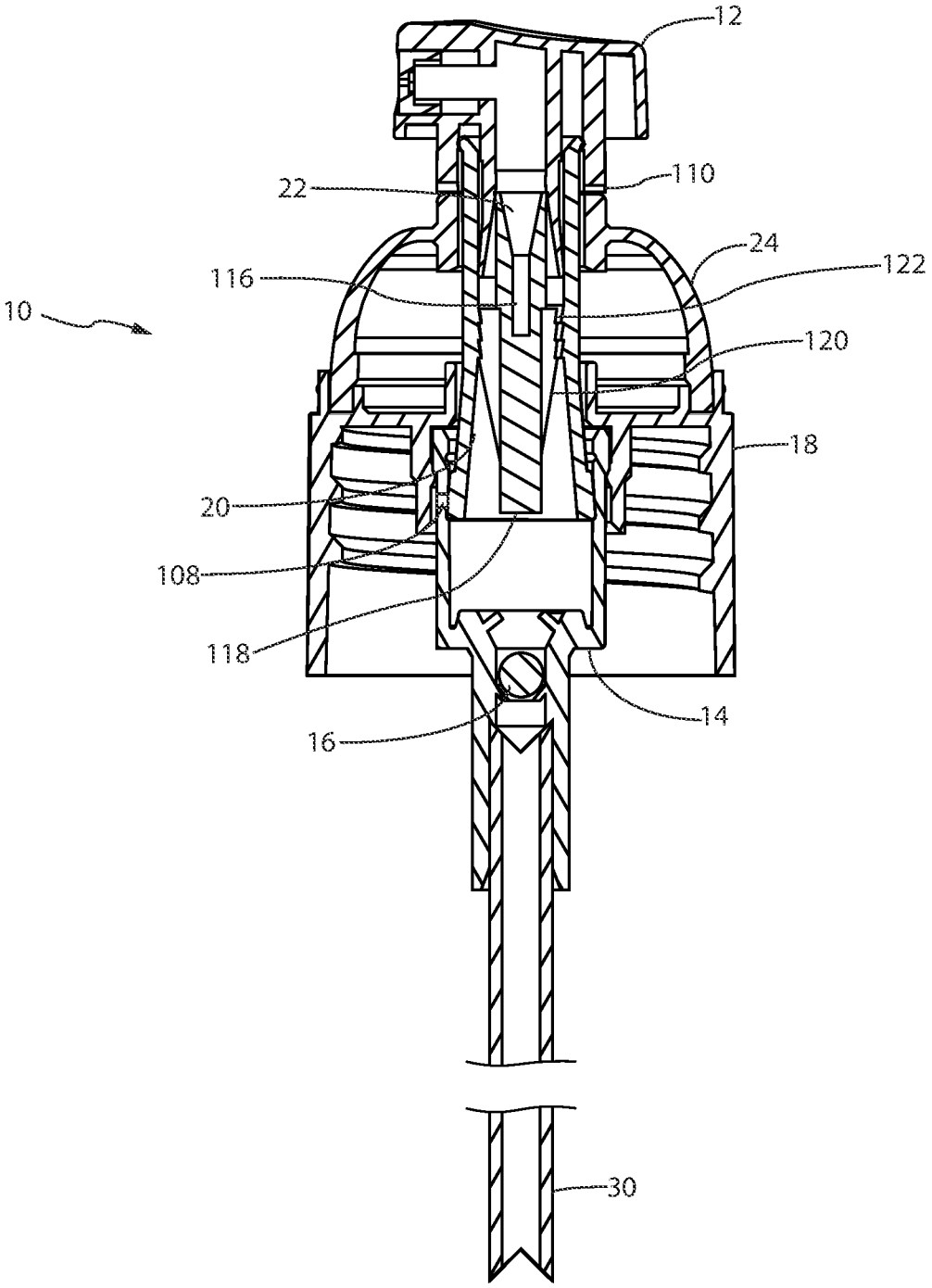
FIG. 2A is a cross-sectional view of the hand pump of the present invention with the actuator in the raised or at rest position.

With reference to FIGS. 2A-2B and 7A-7B, the plastic return spring 24 of the present invention hand pump 10 comprises a generally dome-shaped body portion 94 with a neck portion 96. The plastic return spring 24 includes an upper opening 98 formed in the neck portion 96 and a lower circumference 100. The upper opening 98 of the neck portion 96 is configured to be in a slip fit relationship with the cylindrical exterior surface 62 of the center tube 46 of the actuator 12 (see FIG. 4A). The neck portion 96 includes a ring-shaped surface 102 which abuts a ring-shaped face 105 of the actuator 12. The lower edge 84 of the plastic return spring 24 is retained within the circular retaining channel 82 (see FIG. 6A) of the closure 18. As shown in FIGS. 2A and particularly 2B, the plastic return spring 24 functions as a compression spring. In the exemplary embodiment, the plastic return spring 24 is made from elastic materials such elastomers and plastomers. Other elastic materials are also suitable.

Assembly of the Hand Pump

With reference to FIGS. 2A and 2B and 3A to 7B, in a first step, the plastic ball 74 is placed in the lower check valve 16 formed in the lower body 72 of the pump housing 14. In a second step, the piston 20 is placed in the cylindrical bore of the upper body 70 of the pump housing 14.

In a third step, the pump housing 14 is snapped into the closure 18, i.e. the upper end 92 of the upper body 70 of the pump housing 14 is engaged with the lower ring-wall 90 of the closure 18 via a snap fit.

In a fourth step, the plastic return spring 24 is added to the closure 18, i.e. the lower circumference 100 of the plastic return spring 24 is seated within the circular retaining channel 82 of the closure 18.

In a fifth step, the actuator 12 is connected to the piston 20. In particular, the lower end 48 of the center tube 46 is configured to slide within the upper portion 32 of the piston 20 and engage via a snap fit with the upper lip 38 of the upper portion 32 of the piston 20. When assembled, the ring-shaped face 105 of the ring element 104 of the actuator 12 abuts the ring-shaped surface 102 of the plastic spring 24.

Operation of the Hand Pump

The hand pump 10 of the present invention has two strokes, i.e. a downstroke and an upstroke, which cause the piston 20 to reciprocate within the upper body 70 of the pump housing 14. A downstroke of the actuator 12 and the piston 20 connected thereto, opens the upper valve 22 and closes the lower valve 16 and thereby pressurizes the internal volume 68 of the pump housing 14. The pressurized contents of the internal volume 68 of the pump housing 14 are consequently forced through the upper check valve 22 and out of the nozzle 45 of the actuator 12. On an upstroke, the upper check valve 22 closes and the lower check valve 16 opens, which causes the liquid 28 in the dispenser container 26 to be drawn into the upper body 70 of the pump housing 14 via the dip tube 30 which is in fluid communication with the dispenser container 26 and the upper body 70.

Figure 2B:
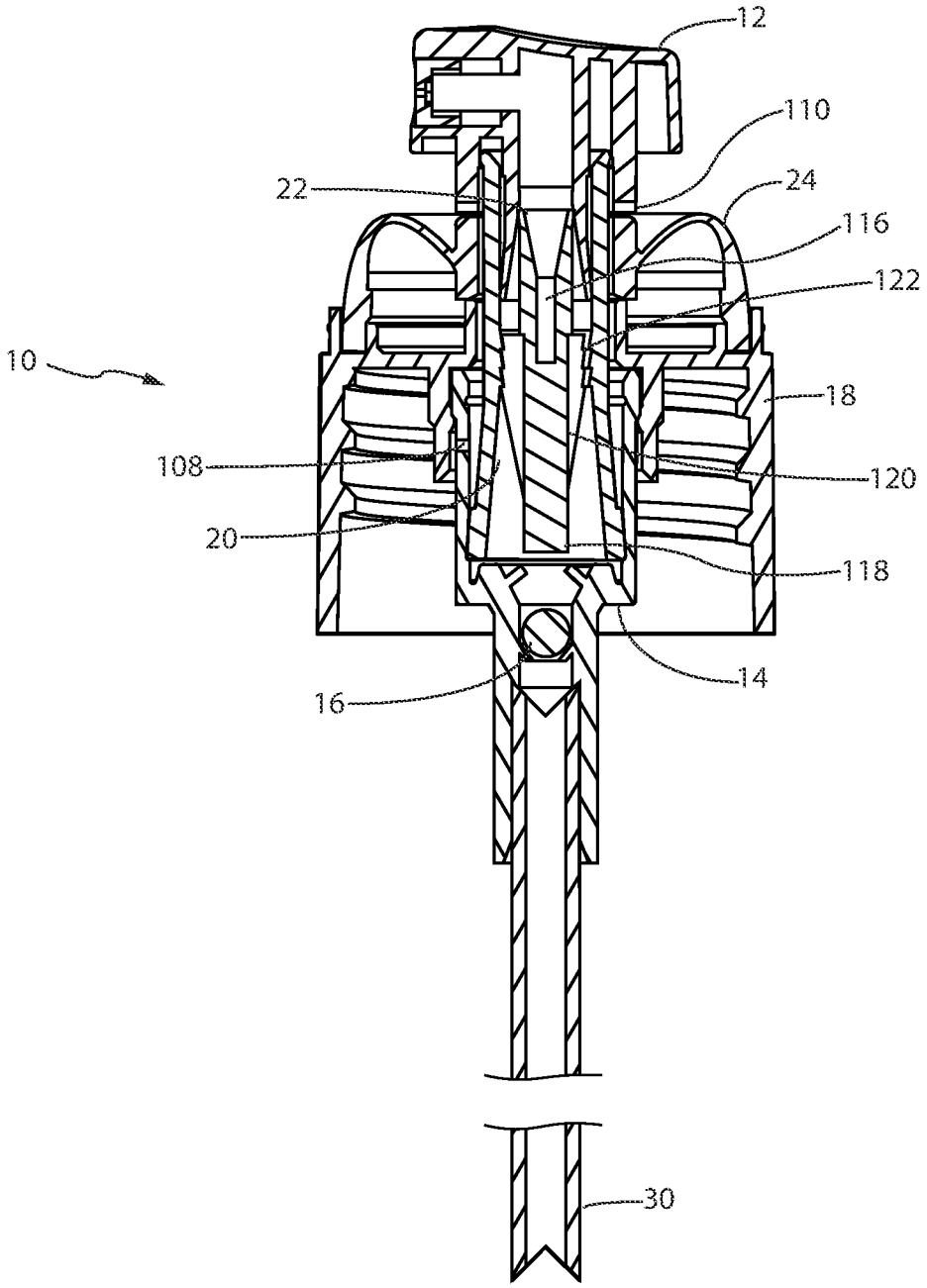
FIG. 2B is a cross-sectional view of the hand pump of FIG. 2A, showing the actuator in depressed position.
Figure 3A:
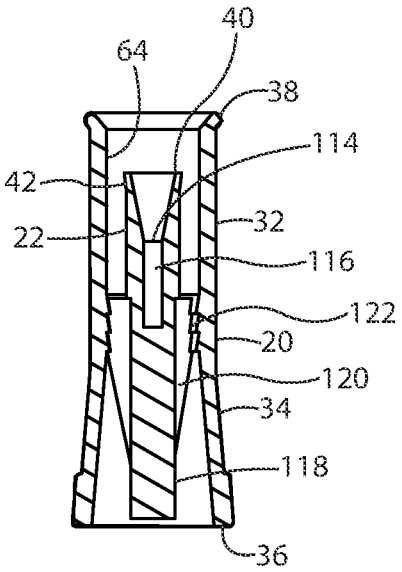
FIG. 3A is cross-sectional view of the piston of the hand pump of FIG. 2A.
Figure 3B:
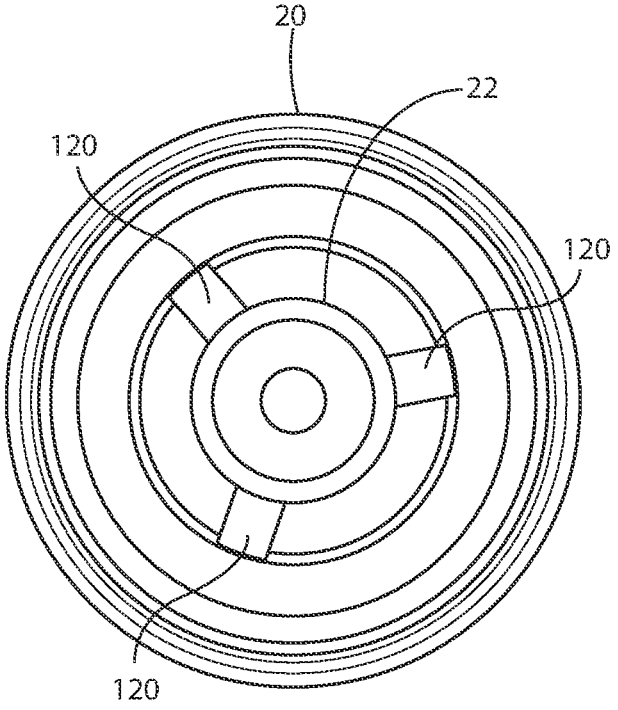
FIG. 3B is a top view of the piston shown in FIG. 3A.
Figure 4A:
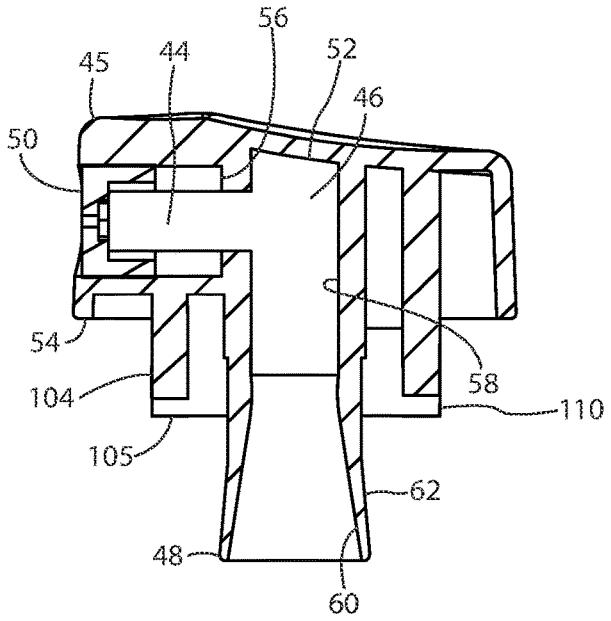
FIG. 4A is cross-sectional view of the actuator of the hand pump of FIG. 2A.
Figure 4B:
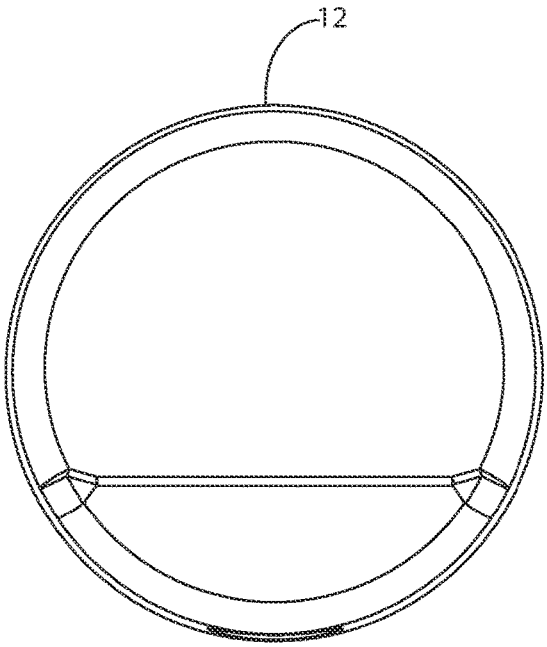
FIG. 4B is a top view of the actuator of shown in FIG. 4A.
Figure 5A:
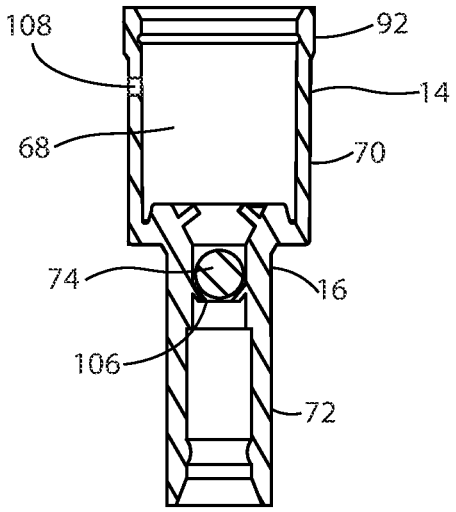
FIG. 5A is cross-sectional view of the pump housing of the hand pump of FIG. 2A.
Figure 5B:
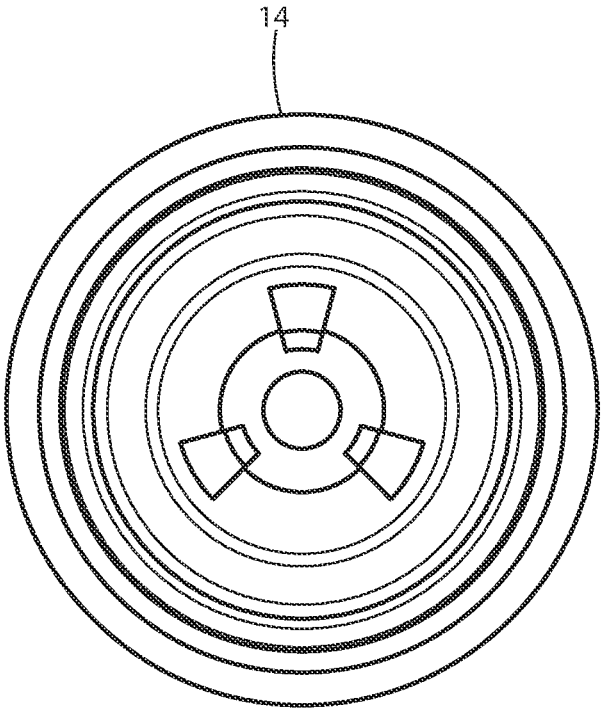
FIG. 5B is a top view of the pump housing shown in FIG. 5A.
Figure 6A:
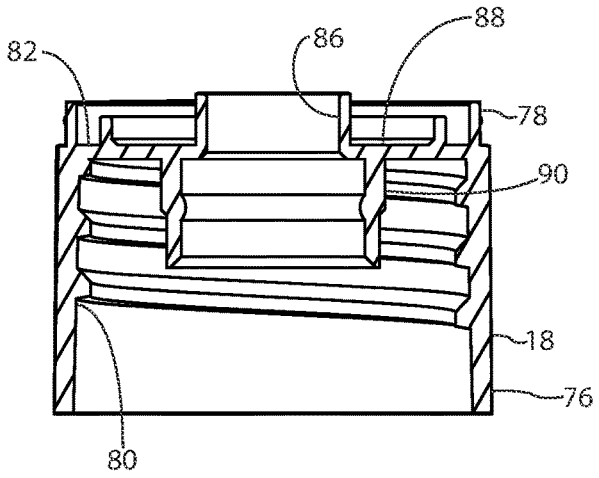
FIG. 6A is cross-sectional view of the closure of the hand pump of FIG. 2A.
Figure 6B:
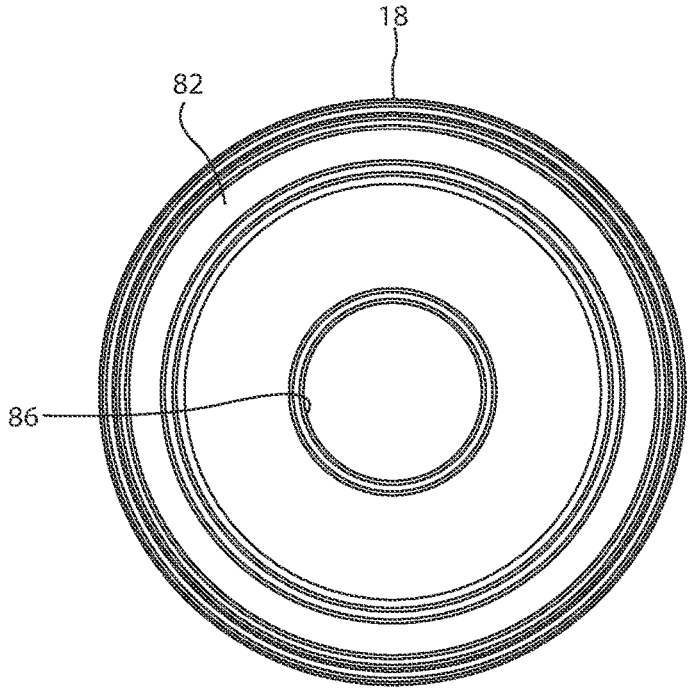
FIG. 6B is a top view of the closure shown in FIG. 6A.
Figure 7A:
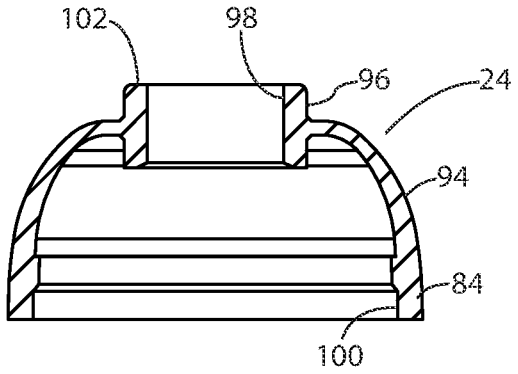
FIG. 7A is cross-sectional view of the plastic return spring of the hand pump of FIG. 2A.
Figure 7B:
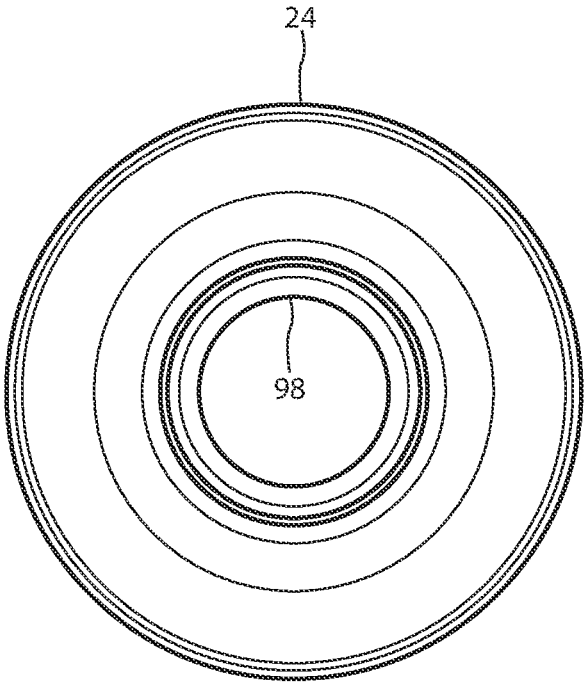
FIG. 7B is a top view of plastic return spring shown in FIG. 7A.

With reference to FIGS. 2A and 2B, and assuming the pump has not previously been used, i.e. is dry or unprimed, the hand pump 10 of the present invention operates as follows. In a first step, a user presses downwardly on the actuator 12. Downwards movement of actuator 12 simultaneously compresses the plastic return spring 24 and causes the piston 20 to move downwardly, as well. As the piston 20 moves downwardly, pressure increases inside the upper body 70 of the pump housing 14 which causes the lower check valve 16 to close and the upper check valve 22 to open forcing air in the upper body 70 to exit thru the nozzle 45.

The upper check valve 22 comprising an inverted cone suspended within the upper portion 32 of the piston 20 is flexible and consequently, as a downstroke of the actuator pressurizes the pump housing 14, any air or fluid within the pump housing 14 passes by the interface between the upper circumference 40 of upper check valve 22, i.e. of the inverted cone, and the interior wall 60 of the center tube 46 of the actuator 12 and subsequently through the center tube 46 and out the nozzle 45. On a first actuation of a dry pump, air passes the upper check valve 22. On subsequent downstrokes, fluid passes through the upper check valve 22.

In a second step, the actuator 12 is released. When the actuator 12 is released, the plastic return spring 24 drives the actuator 12 and the piston 20 connected thereto upwardly. As the piston 20 moves upwardly, the upper check valve 22 is sealed causing vacuum to be generated inside the pump housing 14, which in turn causes the lower check valve 16 to open and the liquid 28 to be dispensed is then drawn up from the dispenser container 26 into the pump housing 14 via the dip tube 30 which is attached to the lower body 72 of the pump housing 14 and which extends into the volume of liquid 28 held within the dispenser container 26.

In a third step, the actuator 12 is pressed downwardly a second time. As the actuator 12 is pressed downwardly, the plastic return spring 24 is compressed and the piston 20 connected to the actuator 12 moves downwardly as well. Downwards movement of the piston 20 causes pressurization of the pump housing 14. Pressurization causes the lower check valve 16 to close and the upper check valve 22 to open. The liquid 28 in the pump housing 14, previously drawn up from the container in step 2, is forced through the upper check valve 22 and exits the hand pump 10 through the exit orifice 50 of the nozzle 45. After the hand pump 10 is initially primed in step one, each subsequent downstroke and upstroke cycle of the actuator 12 will cause liquid 28 in the upper body 70 of pump housing 14 to be dispensed from the nozzle 45 and fresh liquid 28 to be drawn from the dispenser container 26 into the pump housing 14.

Venting of the Hand Pump

With reference to FIGS. 2A, 2B, 4A and 5A, the hand pump 10 of the present invention is equipped with the at least one air vent 110 formed in the ring element 104 of the actuator 12 which allows air communication between the atmosphere and the interior volume 68 of the pump housing 14 and the interior volume of the dispenser container 26, via the at least one air vent hole 108 of the pump housing 14. It is necessary to equalize the pressure of the interior of the pump body and the interior of the container to allow the hand pump 10 to properly operate.

The vent system of the all plastic hand pump 10 operates as follows: In the at rest position (see FIG. 2A), the piston 20 blocks the at last one air vent hole 108 of the pump housing 14. When the actuator 12 is pushed downwardly, the piston 20 moves downwardly, uncovering or opening the at least one air vent hole 108 in the pump housing 14. Due to a pressure differential between the atmosphere and the interior of the dispenser container 26 on a downstroke of the actuator, air will flow from the atmosphere via the at least one air vent 110 and the at least one air vent hole 108 to the inside of the dispenser container 26.

While the present invention has been described with regards to particular embodiments, it is recognized that additional variations of the present invention may be devised without departing from the inventive concept.

What is claimed is:

1. A hand operated dispensing pump for dispensing a fluid from a container, comprising:

an actuator, a piston, a pump body, an upper check valve, a lower check valve and a return spring;

wherein the piston comprises an upper portion and a lower portion, the upper portion configured as a hollow cylinder, the lower portion configured as a hollow truncated cone;

wherein the upper check valve is a hollow inverted cone suspended within the piston, the hollow inverted cone having a truncated end with a cylindrical cavity extending therefrom;

wherein the upper check valve is suspended within the piston by a plurality of fins;

wherein the lower check valve is disposed in a pump housing;

wherein the return spring is a dome shaped spring composed of an elastic polymer material;

wherein the pump housing includes a bore within which reciprocates the piston;

wherein the actuator includes a passage in fluid communication with the piston, the piston being in fluid communication with the lower check valve, the lower check valve being in fluid communication with a fluid in a container;

wherein the flow passage of the actuator includes a conical interior surface wherein the conical interior surface at least partially overlaps the hollow inverted cone of the upper check valve;

wherein upon a downstroke of the actuator and the piston connected thereto, the upper check valve opens and the lower check valve closes causing fluid in the bore to be expelled through the actuator; and wherein upon an upstroke of the actuator and the piston connected thereto, fluid is drawn into the bore.

2. The hand operated dispensing pump for dispensing a fluid from a container of claim 1, wherein the upper check valve is suspended within the piston by three fins spaced about an interior of the piston.

3. The hand operated dispensing pump for dispensing a fluid from a container of claim 1, wherein the lower check valve is a ball style check valve.

4. The hand operated dispensing pump for dispensing a fluid from a container of claim 1, wherein the pump is entirely made from plastic.

5. A hand operated dispensing pump for dispensing a fluid from a container, comprising:

an actuator, a piston, a pump body, an upper check valve, a lower check valve and a return spring;

wherein the piston comprises an upper portion and a lower portion, the upper portion configured as a hollow cylinder, the lower portion configured as a hollow truncated cone;

wherein the upper check valve is a hollow inverted cone suspended within the piston, the hollow inverted cone having a truncated end with a cylindrical cavity extending therefrom;

wherein the upper check valve is suspended within the piston by a plurality of fins;

wherein the lower check valve is disposed in a pump housing;

wherein the pump housing includes a bore within which reciprocates the piston;

wherein the actuator includes a passage in fluid communication with the piston, the piston being in fluid communication with the lower check valve, the lower check valve being in fluid communication with a fluid in a container;

wherein upon a downstroke of the actuator and the piston connected thereto, the upper check valve opens and the lower check valve closes causing fluid in the bore to be expelled through the actuator; and wherein upon an upstroke of the actuator and the piston connected thereto, fluid is drawn into the bore.

6. The hand operated dispensing pump for dispensing a fluid from a container of claim 5, wherein the upper check valve is suspended within the piston by three fins spaced about an interior of the piston.

7. The hand operated dispensing pump for dispensing a fluid from a container of claim 5, wherein the flow passage of the actuator includes a conical interior surface wherein the conical interior surface at least partially overlaps the hollow inverted cone of the upper check valve.

8. The hand operated dispensing pump for dispensing a fluid from a container of claim 5, wherein the return spring is dome shaped.

9. The hand operated dispensing pump for dispensing a fluid from a container of claim 8, wherein the return spring is an elastic polymer spring.

10. The hand operated dispensing pump for dispensing a fluid from a container of claim 5, wherein the lower check valve is a ball style check valve.

11. The hand operated dispensing pump for dispensing a fluid from a container of claim 5, wherein the pump is entirely made from plastic.

12. A hand operated dispensing pump for dispensing a fluid from a container, comprising:

an actuator, a piston, a pump body, an upper check valve, a lower check valve and a return spring;

wherein the upper check valve is suspended within the piston, and includes a hollow inverted cone having a truncated end with a cylindrical cavity extending therefrom;

wherein the upper check valve is suspended within the piston by a plurality of fins;

wherein the lower check valve is disposed in a pump housing;

wherein the pump housing includes a bore within which reciprocates the piston;

wherein the actuator includes a passage in fluid communication with the piston, the piston being in fluid communication with the lower check valve, the lower check valve being in fluid communication with a fluid in a container;

wherein upon a downstroke of the actuator and the piston connected thereto, the upper check valve opens and the lower check valve closes causing fluid in the bore to be expelled through the actuator; and wherein upon an upstroke of the actuator and the piston connected thereto, fluid is drawn into the bore.

13. The hand operated dispensing pump for dispensing a fluid from a container of claim 12, wherein the piston comprise an upper portion and a lower portion, the upper portion configured as a hollow cylinder, the lower portion configured as a hollow truncated cone.

14. The hand operated dispensing pump for dispensing a fluid from a container of claim 13, wherein the upper check valve is suspended within the piston by three fins spaced about an interior of the piston.

15. The hand operated dispensing pump for dispensing a fluid from a container of claim 14, wherein the flow passage of the actuator includes a conical interior surface wherein the conical interior surface at least partially overlaps the hollow inverted cone of the upper check valve.

16. The hand operated dispensing pump for dispensing a fluid from a container of claim 12, wherein the return spring is dome shaped.

17. The hand operated dispensing pump for dispensing a fluid from a container of claim 16, wherein the return spring is an elastic polymer spring.

18. The hand operated dispensing pump for dispensing a fluid from a container of claim 17, the lower check valve is a ball style check valve.

19. The hand operated dispensing pump for dispensing a fluid from a container of claim 12, wherein the pump is entirely made from plastic.

20. The hand operated dispensing pump for dispensing a fluid from a container of claim 12, further including a closure, wherein the closure interfaces the hand pump with container.

21. The hand operated dispensing pump for dispensing a fluid from a container of claim 1, wherein the plurality of fins suspend the upper check valve within the piston and direct fluid flow.

22. The hand operated dispensing pump for dispensing a fluid from a container of claim 1, wherein a central post is suspended within the piston by the plurality of fins, the central post serving to direct fluid flow and control turbulence.

23. The hand operated dispensing pump for dispensing a fluid from a container of claim 1, wherein the piston includes annular steps.

24. The hand operated dispensing pump for dispensing a fluid from a container of claim 5, wherein the plurality of fins suspend the upper check valve within the piston and direct fluid flow.

25. The hand operated dispensing pump for dispensing a fluid from a container of claim 5, wherein a central post is suspended within the piston by the plurality of fins, the central post serving to direct fluid flow and control turbulence.

26. The hand operated dispensing pump for dispensing a fluid from a container of claim 5, wherein the piston includes annular steps.

27. The hand operated dispensing pump for dispensing a fluid from a container of claim 12, wherein the plurality of fins suspend the upper check valve within the piston and direct fluid flow.

28. The hand operated dispensing pump for dispensing a fluid from a container of claim 12, wherein a central post is suspended within the piston by the plurality of fins, the central post serving to direct fluid flow and control turbulence.

29. The hand operated dispensing pump for dispensing a fluid from a container of claim 12, wherein the piston includes annular steps.

* * * * *